United States Patent [19]

Holtey et al.

[11] Patent Number: 4,683,466

[45] Date of Patent: Jul. 28, 1987

[54] MULTIPLE COLOR GENERATION ON A DISPLAY

[75] Inventors: Thomas O. Holtey, Newton, Mass.; Kenneth E. Bruce, Nashua, N.H.; Gary J. Goss, Acton, Mass.

[73] Assignee: Honeywell Information Systems Inc., Waltham, Mass.

[21] Appl. No.: 681,539

[22] Filed: Dec. 14, 1984

[51] Int. Cl.[4] ..... G09G 1/16; G09G 1/28

[52] U.S. Cl. ..... 340/703; 340/747; 340/798; 364/900

[58] Field of Search ... 364/200 MS File, 900 MS File; 340/703, 701, 790, 793, 747, 798

[56] References Cited

U.S. PATENT DOCUMENTS

| | | | |
|---|---|---|---|
| Re. 32,200 | 4/1983 | Sukonick et al. | 340/724 |
| 4,016,544 | 4/1977 | Morita et al. | 364/900 |
| 4,197,590 | 4/1980 | Sukonick et al. | 364/900 |
| 4,429,306 | 1/1984 | Macauley et al. | 340/790 |
| 4,516,118 | 5/1985 | Wahlquist | 340/793 |
| 4,521,770 | 6/1985 | Rhyne | 340/701 |
| 4,578,673 | 3/1986 | Yianilos et al. | 340/701 |

*Primary Examiner*—Eddie P. Chan

*Attorney, Agent, or Firm*—George Grayson; John S. Solakian

[57] ABSTRACT

A color display graphics system includes three bit map memories for storing bits representing red, green and blue colors respectively. Combinations of bits from the same address locations of each bit map memory display a pixel which could be any one of eight colors: black, blue, green, cyan, red, magenta, yellow or white. A read only memory (ROM) stores patterns made up of sixteen bits in a four-by-four matrix for each of the red, green and blue colors. The 16-bit matrices are stored in their respective bit map memories for subsequent color display. Combinations of matrices may be used to show shades of the above eight colors and the mixing of any of those shades.

7 Claims, 3 Drawing Figures

| PATTERN OCTAL \ COLOR OCTAL | 0 | 1 | 2 | 3 | 4 | 5 | 6 | 7 | |
|---|---|---|---|---|---|---|---|---|---|
| 0 | BLACK | BLUE | GREEN | CYAN | RED | MAGENTA | YELLOW | WHITE | |
| 1 | 0XX0<br>XX00<br>X00X<br>00XX | 0BB0<br>BB00<br>B00B<br>00BB | 0GG0<br>GG00<br>G00G<br>00GG | 0CC0<br>CC00<br>C00C<br>00CC | 0RR0<br>RR00<br>R00R<br>00RR | 0MM0<br>MM00<br>M00M<br>00MM | 0YY0<br>YY00<br>Y00Y<br>00YY | 0WW0<br>WW00<br>W00W<br>00WW | DIAGONAL LINES |
| 2 | X0X0<br>X0X0<br>X0X0<br>X0X0 | B0B0<br>B0B0<br>B0B0<br>B0B0 | G0G0<br>G0G0<br>G0G0<br>G0G0 | C0C0<br>C0C0<br>C0C0<br>C0C0 | R0R0<br>R0R0<br>R0R0<br>R0R0 | M0M0<br>M0M0<br>M0M0<br>M0M0 | Y0Y0<br>Y0Y0<br>Y0Y0<br>Y0Y0 | W0W0<br>W0W0<br>W0W0<br>W0W0 | VERTICAL LINES |
| 3 | 00X0<br>X000<br>000X<br>0X00 | 00B0<br>B000<br>000B<br>0B00 | 00G0<br>G000<br>000G<br>0G00 | 00C0<br>C000<br>000C<br>0C00 | 00R0<br>R000<br>000R<br>0R00 | 00M0<br>M000<br>000M<br>0M00 | 00Y0<br>Y000<br>000Y<br>0Y00 | 00W0<br>W000<br>000W<br>0W00 | 25% |
| 4 | 0X0X<br>0X0X<br>X0X0<br>X0X0 | 0B0B<br>0B0B<br>B0B0<br>B0B0 | 0G0G<br>0G0G<br>G0G0<br>G0G0 | 0C0C<br>0C0C<br>C0C0<br>C0C0 | 0R0R<br>0R0R<br>R0R0<br>R0R0 | 0M0M<br>0M0M<br>M0M0<br>M0M0 | 0Y0Y<br>0Y0Y<br>Y0Y0<br>Y0Y0 | 0W0W<br>0W0W<br>W0W0<br>W0W0 | 50% |
| 5 | X0X0<br>X0X0<br>0X0X<br>0X0X | B0B0<br>B0B0<br>0B0B<br>0B0B | G0G0<br>G0G0<br>0G0G<br>0G0G | C0C0<br>C0C0<br>0C0C<br>0C0C | R0R0<br>R0R0<br>0R0R<br>0R0R | M0M0<br>M0M0<br>0M0M<br>0M0M | Y0Y0<br>Y0Y0<br>0Y0Y<br>0Y0Y | W0W0<br>W0W0<br>0W0W<br>0W0W | 50% |
| 6 | 0XXX<br>XX0X<br>X0XX<br>XXX0 | 0BBB<br>BB0B<br>B0BB<br>BBB0 | 0GGG<br>GG0G<br>G0GG<br>GGG0 | 0CCC<br>CC0C<br>C0CC<br>CCC0 | 0RRR<br>RR0R<br>R0RR<br>RRR0 | 0MMM<br>MM0M<br>M0MM<br>MMM0 | 0YYY<br>YY0Y<br>Y0YY<br>YYY0 | 0WWW<br>WW0W<br>W0WW<br>WWW0 | 75% |
| 7 | X000<br>00X0<br>0X00<br>000X | B000<br>00B0<br>0B00<br>000B | G000<br>00G0<br>0G00<br>000G | C000<br>00C0<br>0C00<br>000C | R000<br>00R0<br>0R00<br>000R | M000<br>00M0<br>0M00<br>000M | Y000<br>00Y0<br>0Y00<br>000Y | W000<br>00W0<br>0W00<br>000W | 25% |

| | | |
|---|---|---|
| WYYY<br>YYWY<br>YWYY<br>YYYW | MRMR<br>MRMR<br>RMRM<br>RMRM | W0C0<br>C0W0<br>0W0C<br>0C0W |

Fig. 3.

MULTIPLE COLOR GENERATION ON A DISPLAY

RELATED APPLICATIONS

The following U.S. patent applications, one of which is filed on an even date with the instant application, are assigned to the same assignee as the instant application, are related to the instant application and are incorporated herein by reference.

1. "Automatic Pattern Generation for a Graphics Display" by Kenneth E. Bruce, Thomas O. Holtey and Gary J. Goss, having U.S. Ser. No. 637,680 and filed on Aug. 6, 1984.
2. "Apparatus for Distortion Free Clearing of a Display During a Single Frame Time" by Kenneth E. Bruce, having U.S. Ser. No. 681, 537 and filed on Dec. 14, 1984.

BACKGROUND OF THE INVENTION

1. Field of the Invention

This invention relates generally to a graphics display in a data processing system, and more particularly to the automatic generation of different colors and shades of colors to fill out areas of the display.

2. Description of the Prior Art

Graphics and alphanumeric text are displayed visually in many business applications. This allows the relationship between many variables of the business to be presented in pie chart or bar graph form. The graphics may also be used to display and manipulate mechanical or electronic designs in color.

In order to readily differentiate between areas of the graphics display, adjacent areas may be filled using different colors for adjacent areas.

It has been shown that the use of color displays reduces the operator error rate considerably.

Prior art systems use a number of techniques for displaying color. One technique uses multiple memory planes for storage of codes representing different colors and shades. This approach requires a large amount of memory with its associated control logic.

A second approach uses an analog display tube whereby varying signal levels represented by coded information stored in multiple planes of memory. This method requires large amounts of memory plus analog circuitry to drive a more expensive display tube.

A third approach uses software to mix the colors by having coded information stored in main memory for each desired color. These codes are used to do paints to bit mapped memories by overlaying different colored patterns to obtain desired colors. This software approach provides additional overhead for the operating system thereby requiring additional memory and also reducing the throughput of the system.

OBJECTS OF THE INVENTION

It is a primary object of the invention to have an improved display system.

It is an object of the invention to have an improved graphics display system.

It is another object of the invention to have an improved graphics system which uses improved apparatus for coloring different areas of the display with different colors.

It is yet another object of the invention to have an improved graphics system which uses improved apparatus for coloring different areas of the display with different shades of the same color.

It is still yet another object of the invention to have an improved graphics system which uses improved apparatus for coloring different areas of the display by mixing colors.

SUMMARY OF THE INVENTION

A color display graphics system includes three bit map memories for storing bits representing red, green and blue colors respectively. Combinations of bits from the same address locations of each bit map memory display a pixel which could be any one of eight colors: black, blue, green, cyan, red, magenta, yellow or white.

A read only memory (ROM) stores patterns made up of 16 bits in a four-by-four matrix for each of the red, green and blue colors. The 16-bit matrices are stored in their respective bit map memories for subsequent color display.

A matrix may have 4, 8, 12, or 16 bits at binary ONE to display a 25%, 50%, 75% or 100% of a specific color. Also, two 25% matrices may each be arranged in a pattern that they may be combined without overlap. One of the 25% matrices may be combined with a 75% matrix to display a color on all 16 pixels of the display. One of the 25% matrices may be combined with a 50% matrix without overlap.

Combinations of matrices may be used to show shades of the above colors by combining white or black with the remaining colors or to show combinations of the other six colors.

The graphics system operates in one of three modes of operation, a REPLACE, an OR or an EXCLUSIVE OR mode of operation. The REPLACE mode of operation replaces the color pattern previously written into the area, the OR mode of operation superimposes a selected color pattern on the existing color pattern, and the EXCLUSIVE OR mode of operation superimposes the selected color pattern on the displayed color pattern except that a color bit stored at an address of a bit map memory is erased if the new color bit is written into that addressed position resulting in a binary ZERO in that position.

Logic couples the ROM to the bit map memories. Two bits for each color bit which indicate the mode of operation and binary state of the color bit are combined with an addressed bit from the respective bit map memory in accordance with the mode of operation to generate the new color bits to be written into their respective bit map memories.

BRIEF DESCRIPTION OF THE DRAWINGS

The novel features which are characteristic of the invention are set forth with particularity in the appended claims. The invention itself, however, both as to organization and operation may best be understood by reference to the following description in conjunction with the drawings in which:

FIG. 3 shows a layout of read only memory (ROM) mosaics and combinations of ROM mosaics.

DESCRIPTION OF THE PREFERRED EMBODIMENT

Figure 1:
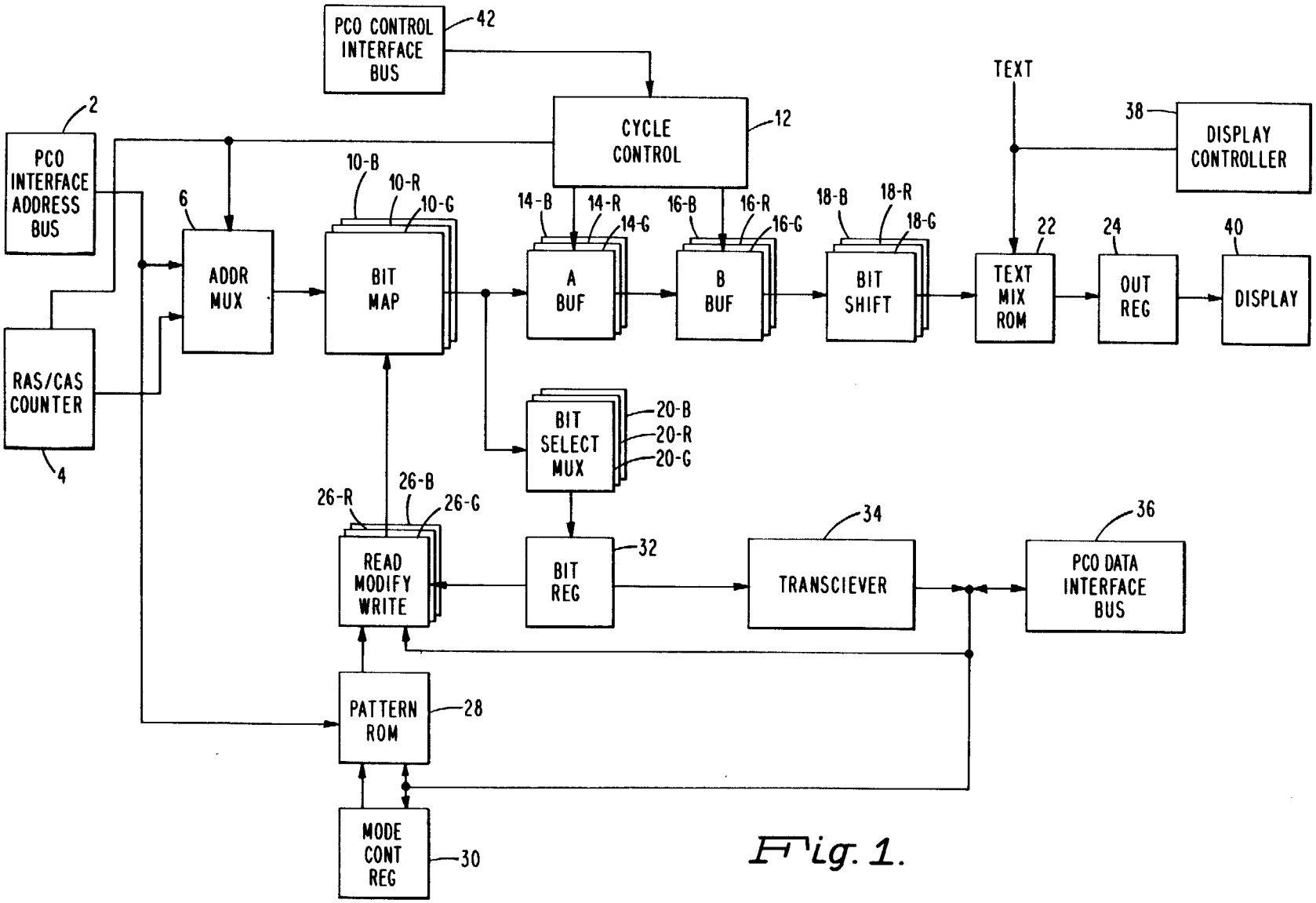
FIG. 1 shows an overall block diagram of the graphics system.

FIG. 1 shows an overall block diagram of a display subsystem for displaying graphics in color on a display 40, typically a cathode ray tube (CRT) display.

Address information is received by the graphics display subsystem from a personal computer option (PCO) interface address bus 2. Data information is received from a PCO interface data bus 36 and control information is received from a PCO interface control bus 42. The PCO interface may receive information from a typical personal computer (not shown) or any typical data processing system (not shown).

The graphics display is aimed at the business graphics marketplace wherein the ability to generate and modify color pie charts, line charts and the like is a requirement.

Bit map memory 10-G stores bits which represent a green image on the display 40, bit map memory 10-R stores bits which represent a red image on the display 40 and bit map memory 10-B stores bits which represent a blue image on the display 40.

The bit map memories 10-G, 10-R and 10-B are addressed via an address multiplexer (MUX) 6 from either the PCO interface address bus 2 or the row and column address (RAS/CAS) counter 4. The address signals from the PCO interface address bus 2 may be used to update portions of the display with data received from the PCO interface data bus 36. The address signals from the RAS/CAS counter 4 may be used to sequentially read out the bits from the bit map memories 10-G, 10-R and 10-B for display on display 40. Note that eight possible colors are possible by using combinations of the same address location in each of the bit map memories 10-G, 10-R and 10-B for displaying a pixel.

A cycle control 12 which receives control signals from PCO interface control bus 42 controls the operation of the address MUX 6 and the RAS/CAS counter 4 to read bytes from bit map memories 10-G, 10-R and 10-B; A buffers 14-G, 14-R and 14-B; B buffers 16-G, 16-R and 16-B; and shift registers 18-G, 18-R and 18-B, respectively. A bit from each bit map memory 10-G, 10-R and 10-B representative of a pixel addresses a text mix read only memory (ROM) 22. The output signals of ROM 22 are applied to an output register 24 for transfer to display 40 for displaying the color pixel.

Address signals from PCO interface address bus 2 are also applied to a pattern ROM 28 which provides signals to bit map memories 10-G, 10-R and 10-B to provide shades of the eight basic colors for the display in defined areas. A mode and output register 30 provides signals to define the mode of operation, either a REPLACE mode, an OR mode or an EXCLUSIVE OR mode.

Bit select multiplexers (MUX) 20-G, 20-R and 20-B each select a bit from the byte read from the bit map memories 10-G, 10-R and 10-B, respectively, for storage in a bit register 32. The bit register output signals are applied to a read modify write 26. The read modify write 26 also receives the data bits from the pattern ROM 26 and performs the specified operation as indicated by the contents of mode control register 30 and writes the output of a read modify write 26 into the bit map memories 10-G, 10-R and 10-B.

Figure 2:
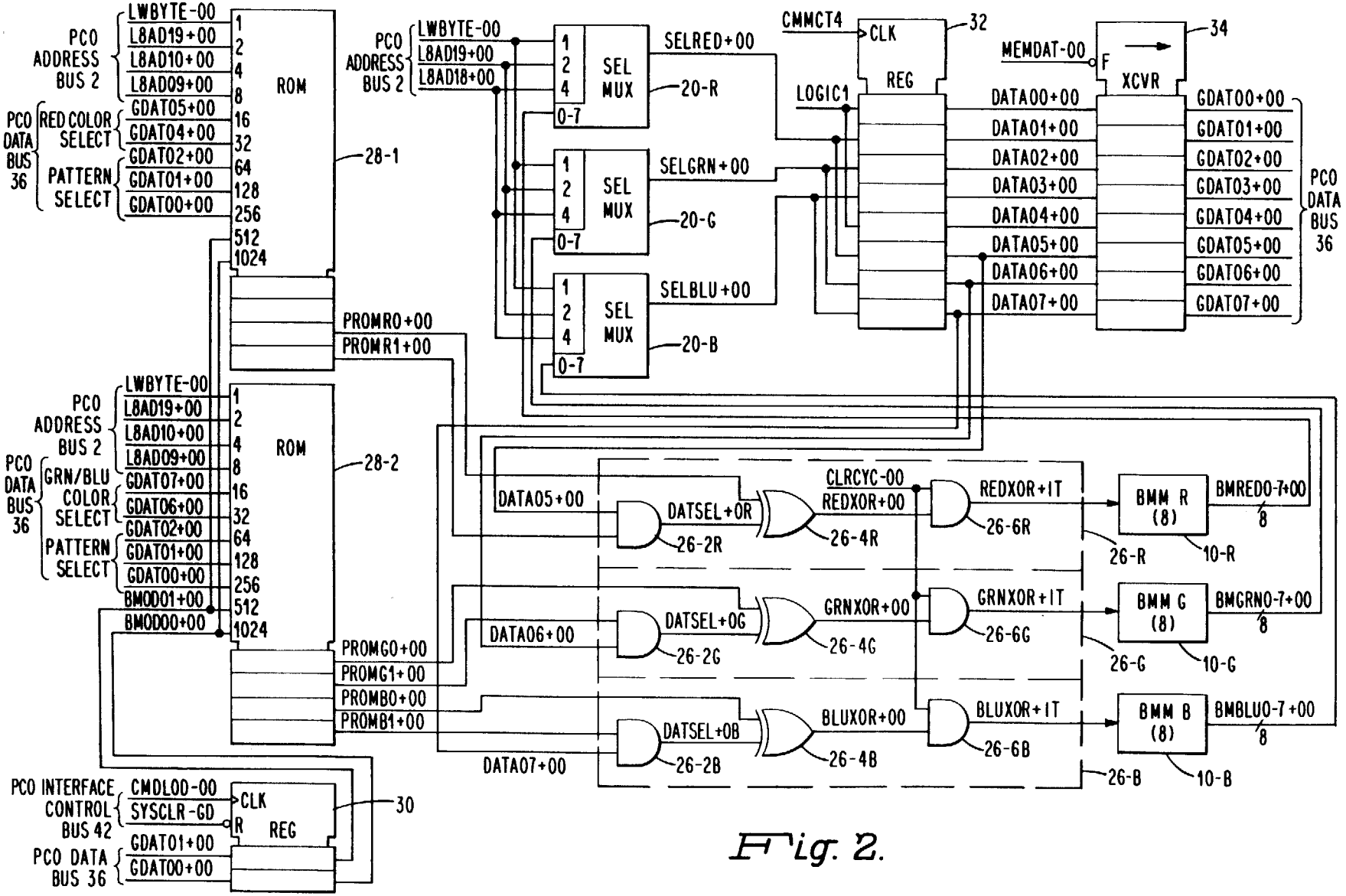
FIG. 2 shows a detailed logic diagram of the color pattern generation logic.

FIG. 2 shows the detailed logic which updates the bit map memories 10-R, 10-G and 10-B. A ROM 28-1 stores bit patterns for updating bit map memory 10-R and ROM 28-2 stores bit patterns for updating bit map memories 10-G and 10-B. Each of the bit map memories, 10-R 10-G and 10-B controls their respective colors red, green and blue. As shown in FIG. 3, combinations of red, green and blue as shown by the color octal numbers make up the five other colors black, cyan, magenta, yellow and white. As an example, combining octal 2 green (binary 010) with octal 4 red (binary 100) gives octal 6 yellow (binary 110).

The logic of FIG. 2 operates in one of three modes of operation as defined by mode signals BMOD00+00 and BMOD01+00. Signals BMOD00+00 and BMOD01+00 at logical ZERO define a REPLACE operation. In the REPLACE mode of operation, a pixel stored in the bit map memories 10-R, 10-G and 10-B is replaced by the addressed bit pattern stored in ROM 28-1 and ROM 28-2 which represents the new pixel. Note that a pixel represents a bit position on the display 40 made up of combinations of the three basic colors red, blue and green.

Signal BMOD00+00 at logical ZERO and signal BMOD01+00 at logical ONE define an OR mode of operation. In the OR operation, the new pixel displayed on the display 40 is made up of the bit pattern representing the new pixel superimposed on the old pixel.

The OR operation allows the changing of the color of an area of display 40 by adding an appropriate bit to the bit map memories 10-G, 10-R and/or 10-B.

Signal BMOD00+00 at logical ONE and signal BMOD01+00 at logical ZERO define an EXCLUSIVE OR mode of operation. The EXCLUSIVE OR mode allows the setting of a pixel to a binary ONE only if the stored pixel and the selected pattern pixel are different—one equal to a binary ONE and the other equal to a binary ZERO. If the stored and selected pixels are equal, either both binary ZERO or both binary ONE, the resulting stored pixel will be a binary ZERO. This action will facilitate the erasing of a pixel pattern if the identical pixel pattern is written a second time. The EXCLUSIVE OR operation allows the changing of the color of an area by removing or adding appropriate bits from the bit map memories 10-G, 10-R and/or 10-B.

REPLACE Mode of Operation

For the REPLACE mode of operation, signals PROMR1+00, PROMG1+00 and PROMB1+00 are at logical ZERO. Signals PROMR0+00, PROMG0+00 and PROMB0+00 indicate either a binary ONE or binary ZERO value depending on the value of the new pixel desired on display 40.

AND gates 26-2R, 26-2G and 26-2B are disabled by signals PROMR1+00, PROMG1+00 and PROMB1+00, respectively, forcing output signals DATSEL+0R, DATSEL+0G and DATSEL+0B to logical ZERO thus negating the value of stored data. The output signals REDXOR+00, GENXOR+00 and BLUXOR+00 from exclusive OR gates 26-4R, 26-4G and 26-4B, respectively, therefore reflect the state of the input signals PROMR0+00, PROMG0+00 and PROMB0+00 which are written into bit map memories 10-R, 10-G and 10-B via AND gates 26-6R, 26-6G and 26-6B and signals REDXOR+1T, GRNXOR+1T and BLUXOR+1T.

OR Mode of Operation

During the OR mode of operation, signal PROMR0+00 is at logical ONE and signal

PROMR1+00 is at logical ZERO if a binary ONE bit is to be stored in the addressed location of bit map memory 10-R. AND gate 26-2R is disabled and signal REDXOR+00, the output of exclusive OR gate 26-4R, is at logical ONE and is written into bit map memory 10-R via AND gate 26-6R and signal REDXOR+1T. Signal CLRCYC−00 is at logical ZERO only during the clear bit map memory operation as described in copending related application Ser. No. 681,537 entitled "Apparatus for Distortion Free Clearing of a Display during a Single Frame Time".

Binary ONE's are written into bit map memories 10-G and 10-B in a similar manner during the OR mode of operation.

Also, during the OR mode of operation, signal PROMR0+00 is at logical ZERO and signal PROMR1+00 is at logical ONE if a binary ZERO is to be OR'ed with the bit stored in the addressed location of bit map memory 10-R. Signal PROMR1+00 enables AND gate 26-2R thus allowing the value of the stored data bit DATA05+00 to be reflected on its output. At the conclusion of the OR operation, the addressed location will retain the same bit level before the OR operation as following the OR operation if a binary ZERO is the selected bit pattern to be OR'ed into the bit map memories 10-R, 10-G and 10-B.

Bits are read from an addressed location in bit map memory 10-R as follows. Eight output signals BMRED0+00 through BMRED7+00 are applied to input terminals of a select multiplexer (MUX) 20-R. Address signals LWBYTE−00, L8AD19+00 and L8AD18+00 from PCO interface address bus 2 select one of the eight signals to generate signal SELRED+00 which is to be stored in register 32 on the rise of timing signal CMMCT4. Signal DATA05+00 from register 32 is applied to AND gate 26-2R which generates signal DATSEL+0R. Signal DATSEL+0R is applied to EXCLUSIVE OR gate 26-6R which generates signal REDXOR+00 having the same state as signal DATA05+00 since signal PROMR0+00 is at logical ZERO. Signal REDXOR+1T therefore is written into bit map memory in the same address location and having the same state as the bit that caused the generation of signal DATA05+00.

Also for the OR mode of operation, signal DATA06+00 is generated by MUX 20-6 and applied to AND gate 26-2G and reflects the state of the bit read from the addressed location of bit map memory 10-G. Signal DATA07+00 is generated by MUX 20-B and applied to AND gate 26-2B and reflects the state of the bit read from the addressed location in bit map memory 10-B. Signals DATA06+00 and DATA07+00 are processed in a similar manner as signal DATA05+00 described above.

Note that AND gates 26-2R, 26-2G and 26-2B are active during the OR mode of operation when a pattern representing a binary ZERO is read from ROM's 28-1 and 28-2.

EXCLUSIVE OR Mode of Operation

For the EXCLUSIVE OR mode of operation, signal PROMR1+00 is at logical ONE enabling AND gate 26-2R. Signal PROMR0+00 reflects the state of the selected pattern bit read from PROM 28-1, that is, at logical ONE for a ONE bit and at logical ZERO for a ZERO bit.

As described above, signal DATA05+00 would be at logical ONE if a ONE bit was read from the addressed location of bit map memory 10-R. Therefore, signal DATSEL+0R applied to exclusive OR gate 26-4R would be at logical ONE. If signal PROMR0+00 was at logical ONE indicating a ONE bit read from PROM 28-1, then output signal REDXOR+00 would be at logical ZERO and a ZERO bit would be written into the addressed location of bit map memory 10-R.

If signal PROMR0+00 was at logical ZERO indicating a ZERO bit read from ROM 28-1, then signal REDXOR+00 would be at logical ONE and a ONE bit would be written in the addressed location of bit map memory 10-R.

If signal DATA05+00 was at logical ZERO indicating a ZERO bit read from the addressed location of bit map memory 10-R, then the state of signal PROMR0+00 would be written into the addressed location.

Transceiver 34 places the bits read from the addressed locations of bit map memories 10-R, 10-G and 10-B onto the PCO interface data bus 36 as signals GDAT00+00 through GDAT07+00 for storage in a main memory (not shown) under control of signal MEMDAT−00 when the reading of bit map memory is commanded.

ROM Layout

FIG. 3 shows the layout of ROM's 28-1 and 28-2 in 16-bit blocks. Each block is bit addressable by signals LWBYTE−00 and L8AD19+00 which select one of four columns and signals L8AD10+00 and L8AD09+00 which select one of four rows.

Pattern octal 0 shows the eight solid colors made up of combinations of red, green and blue in accordance with the following table.

| Color Octal | Red | Green | Blue | Color |
|---|---|---|---|---|
| 0 | 0 | 0 | 0 | Black |
| 1 | 0 | 0 | 1 | Blue |
| 2 | 0 | 1 | 0 | Green |
| 3 | 0 | 1 | 1 | Cyan |
| 4 | 1 | 0 | 0 | Red |
| 5 | 1 | 0 | 1 | Magenta |
| 6 | 1 | 1 | 0 | Yellow |
| 7 | 1 | 1 | 1 | White |

As an example, a yellow pixel on display 40 is made up of a ONE bit read from bit map memory 10-R, a ONE bit read from bit map memory 10-G, and a ZERO bit read from bit map memory 10-B, the three bit map memories being addressed by the same address signals from the address MUX 6, FIG. 1.

In addition to the solid colors, pattern octal 0, a mosaic of pattern octal 1, that is, an area made up of 16-bit blocks, would display diagonal lines in one of eight colors. A mosaic of pattern octal 2 would display vertical lines in one of eight colors.

Patterns octal 3 through octal 7 have only a percentage of the 16 bits displaying the specified color as indicated by the percentage figures on the right side of FIG. 3.

Note that for the 25% patterns only four pixels display color; for the 50% patterns only eight pixels display patterns; for the 75% patterns only twelve pixels display patterns. These patterns display shades of color. The 0 indicates a background color which may or may not be preserved, depending on the mode selected and previously described thus allowing the mixing of colors to attain many different shades and hues.

Also note the pixel patterns which enable colors to be mixed. Pattern octal 7 (25%) of white is mixed with pattern octal 3 (25%) of cyan to give a shade of pink. Mixing pattern octal 5 (50%) of magenta and pattern octal 4 (50%) of red gives a deep red with a blue tint. Also mixing pattern octal 7 (25%) of white with pattern octal 3 (25%) of cyan gives a pale cyan.

The color is selected by signal GDAT05+00 applied to ROM 28-1 and signals GDAT06+00 and GDAT07+00 applied to ROM 28-2. Signals GDAT05+00, GDAT06+00 and GDAT07+00 determine the color octal number of FIG. 3 and are received by the graphics logic from PCO interface data bus 36.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A color display graphics system for displaying a color image, said color image being made up of a plurality of pixels, said system including apparatus for painting areas of said color image with a plurality of colors and a plurality of shades of colors, said apparatus comprising:

a plurality of bit map memory means for storing bits, combination of said bits in corresponding locations of said plurality of bit map memory means determining one of said plurality of colors of a corresponding one of said pixels;

read only memory means coupled to said plurality of bit map memory means for storing a plurality of bit patterns for each of said plurality of colors, a first of said plurality of bit patterns being representative of a plurality of solid colors and a second plurality of said plurality of bit patterns being representative of predetermined shades of said each of said plurality of colors;

a plurality of bit select means coupled to said plurality of bit map memory means, each of said plurality of bit select means selecting a corresponding bit from each of said plurality of bit map memory means; and a plurality of gate means coupled to said plurality of bit select means and to said read only memory means and responsive to plurality of bits from a selected one of said plurality of bit patterns and said corresponding bit from each of said plurality of bit memory means for performing a logical operation and to write the result representing color bit signals back in said corresponding locations of said plurality of bit map memory means for displaying said color image.

2. The apparatus of claim 1 wherein said bit map memory means comprises:

first bit map memory means for storing a plurality of first bits representative of a plurality of red pixels of said color image if said color bit signals represent a red bit;

second bit map memory means for storing a plurality of second bits representative of a plurality of green pixels of said color image if said color bit signals represent a green bit; and third bit map memory means for storing a plurality of third bits representative of a plurality of blue pixels of said color image if said color bit signals represent a blue bit;

wherein combinations of said plurality of first, second and third bits from said corresponding locations generate one of said pixels displaying one of a predetermined number of colors.

3. The apparatus of claim 2 wherein said read only memory means comprises:

a read only memory for storing said plurality of bit patterns, each of said plurality of bit patterns including sixteen bit positions, each of said sixteen bit positions including a binary ONE for a first solid color, four of said sixteen bit positions including a binary ONE in a first plurality of predetermined positions for a first color shade of said first solid color, eight of said sixteen bit positions including a binary ONE in a second plurality of predetermined positions for a second color shade of said first solid color, twelve of said sixteen bit positions including a binary ONE in a third plurality of predetermined positions for a third color shade of said first solid color.

4. The apparatus of claim 3 wherein said read only memory includes four of said sixteen bit positions including a binary ONE in a fourth plurality of predetermined positions for said first color shade of said first solid color, and eight of said sixteen bit positions including a binary ONE in a fifth plurality of predetermined positions for said second color shade of said first solid color;

wherein said first plurality of predetermined positions representative of said first color shade of said first solid color is superimposed on said fourth plurality of predetermined positions representative of said first color shade of a second solid color to generate a fourth color shade;

wherein said second plurality of predetermined positions representative of said second color shade of said first solid color is superimposed on said fifth plurality of predetermined positions representative of said second color shade of said second solid color to generate a fifth color shade; and wherein said third plurality of predetermined positions representative of said third color shade of said first solid color is superimposed on said fourth plurality of predetermined positions representative of said first color shade of said second solid color to generate a sixth color shade.

5. A color display graphics system for displaying a color image, said color image being made up of a plurality of pixels, said system including apparatus for painting areas of said color image with a plurality of colors and a plurality of shades of color, said apparatus being operative in a REPLACE operation, said apparatus comprising:

a plurality of bit map memory means for generating a plurality of primary color signals, combinations of said plurality of primary color signals representative of bits stored in corresponding locations of said plurality of bit map memory means determining one of said plurality of colors of a corresponding one of said pixels;

mode generating means for generating mode signals designating said REPLACE mode of operation;

read only memory means coupled to said plurality of bit map memory means and said mode generating means and responsive to said mode signals for generating a plurality of first signals corresponding to each of said plurality of primary color signals, said plurality of first signals having a state in accordance with said REPLACE mode of operation; and a plurality of bit select means coupled to said plurality of bit map memory means, each of said plurality of bit select means selecting a corresponding bit from each of said plurality of bit map memory means;

a plurality of gate means coupled to said plurality of bit select means and to said read only memory means and responsive to said plurality of first signals and said corresponding bit from each of said plurality of bit memory means for performing a logical operation and to write the result representing color bit signals back in said corresponding location of said plurality of bit map memory means for replacing said bits in said corresponding locations of said plurality of bit map memory means for displaying said color image.

6. A color display graphics system for displaying a color image, said color image being made up of a plurality of pixels, said system including apparatus for painting areas of said color image with a plurality of colors and a plurality of shades of colors, said apparatus being operative in an OR mode of operation, said apparatus comprising:

a plurality of bit map memory means for generating a plurality of primary color signals, combinations of said plurality of primary color signals representative of bits stored in corresponding locations of said plurality of bit map memory means determining one of said plurality of colors of a corresponding one of said pixels;

mode generating means for generating mode signals designating said OR mode of operation;

read only memory means coupled to said plurality of bit map memory means and said mode generating means and responsive to said mode signals for generating a plurality of second signals corresponding to each of said plurality of primary color signals, said plurality of second signals having a state in accordance with said OR mode of operation; and a plurality of bit select means coupled to said plurality of bit map memory means, each of said plurality of bit select means selecting a corresponding bit from each of said plurality of bit map memory means;

a plurality of gate means coupled to said plurality of bit select means and to said read only memory means and responsive to said plurality of second signals and said corresponding bit from each of said plurality of bit memory means for performing an ORing logical operation and to write the result representing color bit signals back in said corresponding locations of said plurality of bit map memory means for displaying said color image.

7. A color display graphics system for displaying a color image, said color image being made up of a plurality of pixels, said system including apparatus for painting areas of said color image with a plurality of colors and a plurality of shades of colors, said apparatus being operative in an EXCLUSIVE OR mode of operation, said apparatus comprising:

a plurality of bit map memory means for generating a plurality of primary color signals, combinations of said plurality of primary color signals representative of bits stored in corresponding locations of said plurality of bit map memory means determining one of said plurality of colors of a corresponding one of said pixels;

mode generating means for generating mode signals designating said EXCLUSIVE OR mode of operation;

read only memory means coupled to said plurality of bit map memory means and said mode generating means and responsive to said mode signals for generating a plurality of third signals corresponding to each of said plurality of primary color signals, said plurality of third signals having a state in accordance with said EXCLUSIVE OR mode of operation; and a plurality of bit select means coupled to said plurality of bit map memory means, each of said plurality of bit select means selecting a corresponding bit from each of said plurality of bit map memory means;

a plurality of gate means coupled to said plurality of bit select means and to said read only memory means and responsive to said plurality of third signals and said corresponding bit from each of said plurality of bit memory means for performing an EXCLUSIVE OR logical operation for replacing said corresponding bits in said plurality of bit map memory means representative of said plurality of color signals by said bits representative of said plurality of third signals for writing a binary ONE in said location in said plurality of bit map memory means if said plurality of third signals and said plurality of color signals indicate different states and writing a binary ZERO in said location of said plurality of bit map memory means if said plurality of third signals and said plurality of color signals indicate the same state.

* * * * *